United States Patent [19]

Backus

[11] Patent Number: 4,763,502

[45] Date of Patent: Aug. 16, 1988

[54] METHOD AND A DEVICE FOR PRETREATING NONFERROUS METAL FOR PLASTIC DEFORMATION

[75] Inventor: Hendricus P. M. Backus, Eysden, Netherlands

[73] Assignee: AMF - Aluteam Metal Forming GmbH, Mayen, Fed. Rep. of Germany

[21] Appl. No.: 885,323

[22] Filed: Jul. 14, 1986

Related U.S. Application Data

[63] Continuation of Ser. No. 416,313, Sep. 9, 1982, abandoned.

[51] Int. Cl.[4] ..... B21C 43/00; B21C 23/00

[52] U.S. Cl. ..... 72/39; 72/262

[58] Field of Search ..... 15/88, 102, 306 A; 29/81 B, 81 F, 81 R; 72/38, 39, 258, 262

[56] References Cited

U.S. PATENT DOCUMENTS

| | | | |
|---|---|---|---|
| 2,279,217 | 4/1942 | Wood | 266/113 |
| 3,093,897 | 6/1963 | Lemyre et al. | 72/39 |
| 3,218,658 | 11/1965 | Collins et al. | 15/88 |
| 3,270,860 | 9/1966 | Siebach | 15/88 |
| 3,525,243 | 8/1970 | Chrablow | 72/39 |
| 3,806,366 | 4/1974 | Cofer et al. | 72/39 |
| 3,811,305 | 5/1974 | Saylor | 72/39 |
| 3,938,214 | 2/1976 | Hodsen et al. | 15/102 |
| 4,028,795 | 6/1977 | Takahashi et al. | 72/38 X |
| 4,185,484 | 1/1980 | Abramsen | 72/40 |
| 4,233,830 | 11/1980 | Houdin | 72/39 X |
| 4,484,876 | 11/1984 | Childs et al. | 72/262 X |

FOREIGN PATENT DOCUMENTS

| | | | |
|---|---|---|---|
| 55-112121 | 8/1980 | Japan | 72/258 |
| 58-35014 | 3/1983 | Japan | 72/262 |
| 878887 | 10/1961 | United Kingdom . | |
| 1415474 | 10/1975 | United Kingdom . | |
| 2026544 | 2/1980 | United Kingdom . | |

OTHER PUBLICATIONS

Continuous Extrusion by the Conform Process, Hunter; SME Technical Paper MF-76-407, 1976.

Extrusion: Processes, Machinery, Tooling, Laue et al., 1976, pp. 16, 17.

*Primary Examiner*—E. Michael Combs

*Attorney, Agent, or Firm*—Berman, Aisenberg & Platt

[57] ABSTRACT

The invention relates to the pretreatment of ductile non-ferrous metal to be deformed in a continuous plastic deforming device (20) in which the surface parts of the metal to be deformed do not substantially form surface parts of the metal after said deformation. Known methods of pretreatment include scaling off of thin surface layers and pickling e.g. in baths and coiling or storing the metal thereafter before feeding to the deforming device. Such methods have disadvantages in view of energy, waste of material and, in many cases, in still having some surface contamination on the metal entering the deforming device. To avoid such disadvantages, the invention proposes to spray the metal with a deoxidation and cleaning agent in one throughgoing operation directly while it is moving to the deforming device and continuously and sychronously therewith. Spraying is done by directing forceful jets of the liquid onto the moving metal surface. The spraying agent is a strong alkali and for some types of alloys there is a further spraying step using an acid such as a strong nitric acid solution in water. The metal is thereupon, while moving on to the deforming device, rinsed with water and dried.

12 Claims, 2 Drawing Sheets

METHOD AND A DEVICE FOR PRETREATING NONFERROUS METAL FOR PLASTIC DEFORMATION

This application is a continuation of application Ser. No. 416,313, filed Sept. 9, 1982, abandoned.

This invention relates to a method and a device for pretreating ductile non-ferrous metal for a continuous plastic deformation treatment in which the surface parts of the metal to be deformed do not substantially form surface parts of the material after said deformation.

Many different methods for plastically deforming metals are known, such as swaging, drawing, extruding and deep drawing. If therein the surface parts of the blank or other metal parts before deformation remain parts of the surface, as is usually the case in metal wire or rod drawing operations, contaminations such as oxides on the surface will also be present on the surface of the metal after deformation, often even in a much lower concentration or layer thickness because the surface area is increased considerably during the deformation. In drawing dies and other active surfaces of plastic deformation tools it is usual to add lubricants to decrease friction and such agents also remain on the surface of the metal and do not cause harm, are divided over a much larger area during the deformation and, if desired, are easily removable thereafter.

The situation is different for deformation methods, in which the surface parts of the metal before deformation will become positioned to a considerable extent inside the metal by the deformation. This is particularly the case in the transverse extruding of metal supplied by a friction roll to the extrusion space, in which in many cases the surface area of the metal after deformation may become even considerably smaller than the surface area before deformation.

Such a method, especially for aluminium and copper, is known as the Conform®-process for continuously extruding e.g. metal feedstock from a continuous casting process (vide e.g. Society of Manufacturing Engineers Technical Paper MF76-407, Dearborn Michigan: Eric Hunter: Continuous Extrusion by the Conform Process).

Contaminations such as grease and oil and oxide layers will in such a method for the greater part turn up in the interior of the final product, where they may give considerable disadvantages. Parts subjected to high stresses, e.g. tubes under internal fluid pressure, may rupture thereby. It is sometimes of importance that such contaminations decrease the electric conductivity. Such contaminations will in part be present on the outer surface of the final product in an irregular, non uniform and locally limited way and this also gives many disadvantages, e.g. that they cannot be anodized uniformly and that there is unevenness and roughness of the surface impairing the appearance of the product and being disadvantageous for further treatment and operations.

It has been tried before to find a solution for such problems by mechanical scaling or shaving away a thin layer of the material before deformation, e.g. a layer of a thickness between 0.8 and 1.4 mm thickness. Deformation methods, to which the invention relates, are normally performed with metal, of which the transverse dimensions are not above 25 mm. This means that the layer scaled off gives a high percentage of refuse material and moreover the scaling or shaving costs much energy, and it is not allowable to lubricate the knives for this treatment as the lubricant would again give the mentioned disadvantage.

It is an object of the invention to give a solution for the problems described so as to avoid the mentioned disadvantages and to this end a method as given in the preamble above is according to the invention characterized in that the metal directly before the plastic deformation and while being supplied to a deforming device for such plastic deformation, continuously and synchronously therewith and directly before reaching said deforming device is sprayed with a liquid deoxidation and cleaning agent.

As a deoxidizing and cleaning agent it is possible to apply Grisal 4506® of Hoechst or a comparable agent manufactured by Henkel, both having a $p_H$ of about 13.5. This is an agent on the basis of a strong alkali, mainly based on sodium hydroxide (caustic soda) and containing phosphates, carbonates, carbon acids and salts, and being free from silicates, wetting agents, nitrates and nitrites. Upon use of such an agent for some types of aluminium alloys, such as those containing magnesium, silicon and/or manganese, there will remain a coating layer containing one or more of these metals on the metal body to be treated and if this is so, it is preferred to spray the metal surface with an acid such as nitric acid immediately after spraying with the alkaline agent. After this spraying the metal should be rinsed e.g., by spraying with water to remove any remnants of the cleaning agent immediately after spraying with the alkaline and/or acid agent. Drying, e.g. by hot air, will be performed after the rinsing with water, but according to the invention also these steps have to take place while the metal is moving to the deforming device and in a through-flow through spraying, rinsing and drying steps immediately upstream of the deforming device as seen in the direction of movement of the metal.

As such, pickling means and pickling methods for treating surfaces of metal bodies are known in many different embodiments.

It has, however, not been suggested before to synchronously clean and deform the metal so that it is cleaned by spraying immediately before a continuous plastic deformation method and while moving with the same speed, with which it is fed thereto. It is usual to perform the known pickling methods before plastically deforming the metal in such a way that it is separate from the deformation method and does not take place continuously and synchronously therewith. Wire and strip metal is often supplied to the pickling device as coils, which are unwound to pass through said device and are wound to a coil again after said treatment (U.S. Pat. No. 2,279,217). It is also possible to wind the metal e.g. as wire material to a coil, which is fed through a pickling bath without uncoiling.

Pickling of material in coil form takes much time by the compact mass of the coils. In pickling baths, whether the metal is in coil form or is fed in unwound condition therethrough, there are usually exothermic chemical reactions between pickling liquid and oxides etc., so that a thin vapour layer is formed on the metal, which retards the pickling by a decrease of contact between bath and metal. By the continuous spraying according to the invention this disadvantage does not occur and this allows much more rapid cleaning immediately before and synchronously and continuously with the deforming operation.

The coiling after pickling has the disadvantage that it complicates the total device and method considerably and takes more time, but particularly in a deforming method of the type to which this invention relates it is of the utmost importance that the metal does not get time to form a new oxide layer even if this would be very thin. This is avoided according to the invention, but if desired it is possible to guide the metal through a space with an inert atmosphere, as is known as such, between the last spraying step and the deforming device, which gives an additional safety against this phenomenon.

The invention may be applied both for a coherent metal strand, strip, wire or rod, e.g. as leaving a continuous-casting device, and for separate metal parts, e.g. for diminuted waste metal such as old aluminium window and door frames cut into smaller parts and having e.g. anodized or similarly coated or treated surfaces. Such smaller parts may be fed through a spraying device and to a deforming device both according to the invention by and while being carried by a conveyor belt of gauze type, the supplying to the deforming device taking place by dumping, pushing or pressing. If the starting material is a continuous or very long profile of small cross-section and easily bendable, e.g. a wire, this may be in coil form when fed to the spraying device, being fed continuously from the coil by unwinding it, through the spraying device and to the deforming device. The unwinding and feeding through the spraying device and to the deforming device may take place by the pulling action of the deforming device or its direct supply means. It has appeared that a spryaing time of 8 seconds in most cases gives a very good result.

The device for performing the method according to the invention is mainly characterized in that it includes conveying means for moving the metal to a device for said plastic deformation in a continuous path and spraying means for spraying the metal with a deoxydation and cleaning agent during this movement.

The invention will now be explained in more detail on the basis of and with reference to the enclosed drawings giving, by way of example only, a preferred embodiment of a device for applying the cleaning method. In said drawings.

Figure 1:
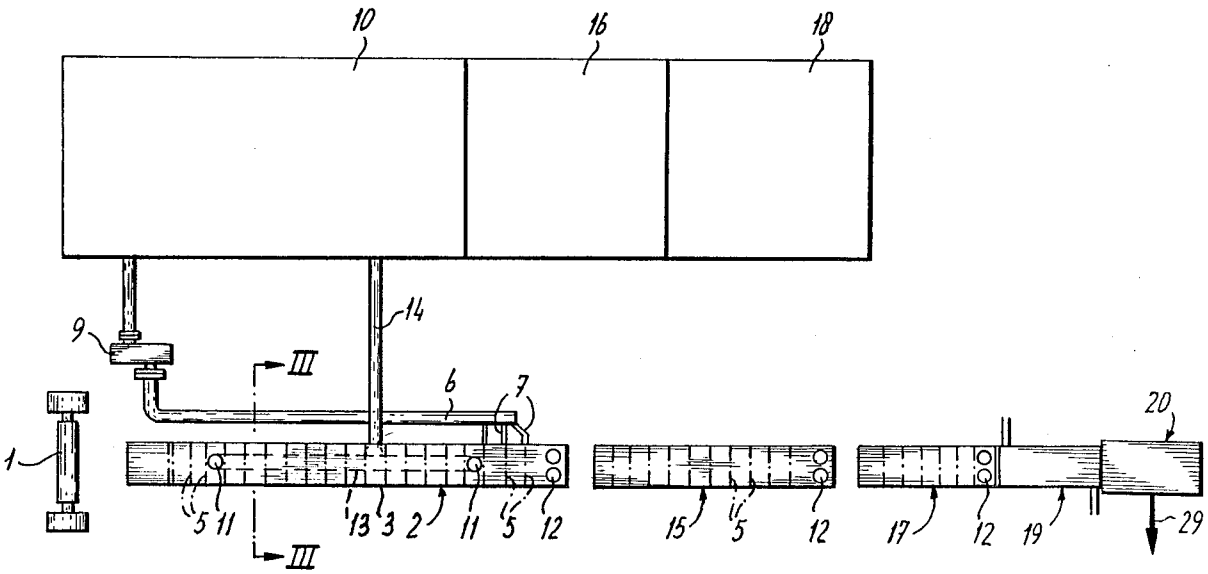
FIG. 1 is a diagrammatic top view of this device.
Figure 3:
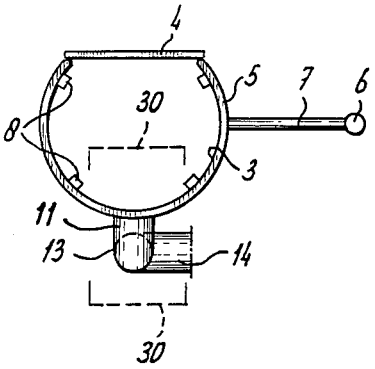
FIG. 3 shows a section on a larger scale through the spraying device along the line III—III in FIG. 1.

In FIG. 1, 1 indicates diagrammatically a supply for the metal to be treated. This supply may be the discharge of a continuous-casting device, e.g. casting vertically downwards in well-known manner to cast a strip, long rod or wire of simple cross-sectional shape, e.g. of an aluminium alloy. There may, however, also be a reel containing a long wound wire or strip at this point. The metal body therefrom is first fed to a first spraying section 2. If necessary the vertically cast metal body is bent into a horizontal direction and at the entry of spraying section 2 there may be vertical guide rollers and horizontal straightening rollers, e.g. in two pairs one after the other, each of two cooperating rollers in the same plane perpendicular to the horizontal direction of movement of the metal body. As appears from FIG. 3, this spraying section is embodied as a trough 3 with a cover 4, normally closing the trough 3 entirely. The trough 3 has a number of ducts 5 for a spraying liquid, extending in vertical planes at mutually equal distances. Said liquid is supplied by a supply duct 6 extending along the trough and having, for each duct 5, a branch duct 7. In FIG. 1 each vertical dot and dash line in the trough represents a duct 5 and only three of the ducts 7 have been shown here. The ducts 5 are shown as extending along the outside of the trough 3, but they may extend along the inside wall thereof. Each duct 5 has a number of spray nozzles 8 within the trough and divided evenly along the length thereof, adapted to direct a forceful jet of spraying liquid onto the metal passing through the trough, which metal is guided through the center of the trough. If the metal body would tend to sag too much, it is easy, as is usual in comparable situations, to apply support brackets or support rollers at adequate mutual distances in the trough.

At the entry and exit of the trough there may be rigid end walls with a small opening allowing passage of the metal and, if it is desired to close the trough entirely around the metal, such end walls may have or may be constituted by one or more curtains or sheets of synthetic rubber or a suitable elastic plastic material to close the end faces of the trough around the metal body. If desired, other end walls may be mounted if a metal body of a different cross-section has to be sprayed.

The supply header duct 6 for the spraying liquid is fed by a pump 9 from a reservoir 10. The liquid sprayed on the metal in the trough is discharged therefrom through two or more openings 11 in the bottom, connected by a discharge pipe 13, from which the liquid thus collected with contaminations, is recycled to reservoir 10 through pipe 14. There are filtering and, if desired, further cleaning means, not shown, to clean this recycled liquid and to remove oxide particles etc. therefrom before it enters reservoir 10.

Figure 4:
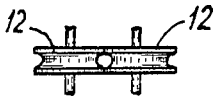
FIG. 4 shows pinching rollers to be applied right after the spraying treatment.

At the downstream end of trough 3, there are guide rollers 12, shown in FIG. 1 as having a vertical axis and also shown in FIG. 4. They not only quite guide the metal body, but also pinch it as it fits in grooves in the periphery of the rollers as shown for a circular rod in FIG. 4. If the metal body has a different shape of cross-section, the grooves in the roller periphery may be different to be adapted thereto. The rollers 12 may also have a horizontal axis and there may be two sets of rollers 12, one with horizontal and one with vertical axes. If the metal body is in the shape of a flat strip, there may be rollers with horizontal axis and of simple cylindrical shape. These rollers 12 may have an outer periphery of an elastic material such as a synthetic rubber or polytetrafluoroethylene and contact the metal body under some pressure to remove as much of the liquid adhering to the metal surface as possible by pinching of the metal between opposite rollers.

From trough 3 the metal body passes to a second spraying section 15, being shorter than section 2 and serving to spray the metal body with another liquid, e.g., for many aluminium alloys, with an acid such as nitric acid. Supply and recycling of the liquid take place by the same means as described for spraying section 2, there being a reservoir 16 for this liquid, and a pump, filter, ducts etc. to and from this reservoir etc., such parts not being shown. This spraying section 15 will have the same shape of the trough, spraying and guide means, rollers 12 and covers in the end walls as described for section 2.

From this section 15 the metal body passes to a spryaing section 17 being fed with rinsing water from a reservoir 18 and being embodied in the same way as a trough like spraying sections 2 and 15, with supply duct, pump and return duct as described for section 2, but this section 17 may have a supply from the water means without a separate pump and return duct to reservoir 18, but discharging the water to a suitable cleaning device and from there to e.g. the municipal sewer system.

Immediately adjacent spraying section 17 there is a drying section 19 having drying means for the metal, preferably by dry heated air, said air flowing at high speed and turbulently along the metal to dry it rapidly. The air may be guided to and fro by baffles to pass the metal several times between an inlet and an outlet. Electric heating means may be provided in this section, together with fan means to circulate the air in the casing thereof to and along such heating means and then over the metal, in which case the air may thus circulate within this device so that only a small part thereof is withdrawn through an outlet to discharge the water vapour and is replaced by dryer air through an inlet. For metal to be treated, which is very vulnerable to as rapid oxidation, an inert gas may be used instead of air.

Figure 2:
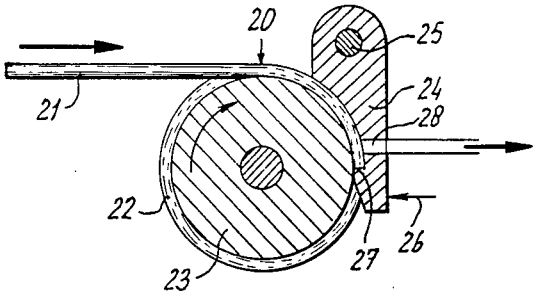
FIG. 2 is a vertical (or horizontal) section of the extrusion device used therewith.

From this drying device the metal body 21 to be treated enters the deforming device 20, shown separately and somewhat diagrammatically in FIG. 2 and representing a Conform ® device as described by Hunter, mentioned above, in which the surface of the metal (here a rod, strip or bar 21) entering the device does substantially not form part of the surface of the extruded product. The strip, rod or bar 21 is fed into a groove 22 in a rotating roll 23, in which groove it fits. The roll 23 is rotated in the direction of the arrow shown therein.

A shoe 24 is pivoted at 25, is pushed by a resilient force towards roll 23 (by a force represented by arrow 26) and at 27 has a stepped part to prevent further movement of the oncoming metal body 21. By friction in the groove 22 of roll 23 and under contact with the shoe 24 keeping the metal body in good contact with the groove the metal is heated and is, by the friction and the continuous supply caused by said friction pulling and pushing the metal up to part 27, put under high pressure. It thus softens and is extruded sideways, in FIG. 2 through opening 28 in the shoe, but there may be an extrusion passage perpendicular to the plane of the drawing, so that the metal leaves the device in a direction which is perpendicular to the direction of supply, as shown by arrow 29 in FIG. 1. There may be, in known manner, more than one extrusion opening; they may have all kinds of shapes, also, if desired, intricate shapes. The device may have any desired position, e.g. the axis of roll 23 may be vertical.

There may be conveying rollers drawing the metal body 21 towards themselves and feeding it to the device. The pulling of such rollers and even, without such rollers, the friction of roll 23 on the metal may pull the metal body from the feed at 1 in FIG. 1 entirely through the spraying device as described, so that the guide means in the latter device need not drive the metal body.

It it is desired to treat discrete metal parts such as waste metal, a.o. shredded window and door frames, such parts are treated in the same way but of course have to be supported over the entire length of the spraying device. To this end, there may be a conveyor belt, shown as 30 in dashed lines in FIG. 3, passing from the metal supply station 1 through all the spraying troughs 3, 15, 17 and the drying means 19 to the extrusion device 20. The belt 30 may be a metal belt of gauze material, if desired coated with a layer of plastic material resistant against the spraying agents.

The belt 30 will have to discharge the metal parts directly to the deforming device 20 and this may be accomplished by providing a small hopper in the entry zone, e.g. exactly on or near the spot where reference numeral 20 is positioned, and belt 30 will then terminate right above this small hopper. This hopper will bring the metal parts immediately in the groove 22 of roll 23 to be passed on, compressed and heated by friction and extruded.

In short, in operation the metal to be treated is sprayed by strong jets from nozzles 8 in spraying section 2 with a strong alkali liquid as described before. Contaminations are thus liberated from the metal and rollers 12 and possibly the curtain in the end face of trough 3 remove much of the spraying liquid adhering to the metal. If the metal is of a type which makes it necessary to spray with an acid thereafter, the metal is sprayed with a solution of 30% nitric acid in water in spraying section 15. If no such treatment is necessary, section 15 may be omitted or removed or be used also to spray the metal with the alkaline agent or with an alkaline agent of a somewhat different composition. In section 17 the metal is rinsed by water, which may have been pretreated to remove hardness or control acidity. In section 19 the metal is dried and immediately thereafter it enters the deforming device 20.

Alkaline agents such as Grisal ® indicated above are commercially available as powders. A suitable spraying liquid is made therefrom by solving thereof in water to form a solution of about 3% (by weight) of the powder. This liquid is preferably heated to a temperature not higher than 70° C. and preferably about 55° C., giving a strong cleaning action without too much vapour. There will be heating means and temperature control means not shown in the system of reservoir 10 and its ducting connecting it to trough 3.

The nitric acid spraying liquid in spraying section 15 is preferably applied at room temperature.

The rinsing water sprayed in section 17 is also preferably at a somewhat elevated temperature such as 55° C. or somewhat higher, to remove the remnants of spraying liquid from the previous spraying section more efficiently and completely in the very short time available and to have the metal body enter the drying section 19 with an elevated temperature promoting rapid drying.

The invention is intended to be applied to ductile non-ferrous metals and in particular to aluminium and copper and many of their alloys.

Many deviations from the above described embodiments are possible within the scope of the appended claims.

What is claimed is:

1. Apparatus for forming an article from an aluminum or aluminum alloy metal body, the entire surface of said metal body being exposed to air, comprising conveying means for continuously moving said metal body to a Conforming extrusion means for deforming said metal body, wherein the metal body to be deformed is not subjected to lubrication during deformation and wherein said surface does not substantially form a surface of said article, spraying means for continuously spraying said surface exposed to air of said metal body with a chemical deoxidation and cleaning agent during said moving, and drying means for continuously drying said metal body after said spraying, wherein said drying means is located immediately adjacent said Conforming extrusion means such that said metal body is subjected to deformation immediately after said drying such that substantially no new oxide layer is formed before said deformation.

2. An apparatus according to claim 1, wherein said Conforming extrusion means (20) has its own conveying means (23) to supply the metal in the shape of a long cohering body to a deforming element of said Conforming extrusion means, the conveying means for moving the metal body along the spraying means substantially consisting of guide means for said metal body without positive drive, the conveying means (23) of said Conforming extrusion means (20) drawing the metal body through the spraying means (2, 15).

3. An apparatus according to claim 2, said guide means comprises freely rotatable guide rollers.

4. An apparatus according to claim 1, in which between the spraying means (2, 15) and said Conforming extrusion means (20) pinching means (12) are provided to engage the metal in the shape of a long cohering body to remove liquid adhering to the metal body.

5. An apparatus according to claim 4, wherein said pinching means (12) includes at least one roller with a groove, into which fits the metal body to be treated, said groove having a surface of an elastic material.

6. An apparatus according to claim 1, in which the spraying means (2, 15) comprises a substantially horizontal and substantially closed tube (3) with guide means to guide the metal body to be treated therethrough, and a plurality of spray nozzles (8) directed to said metal body in said tube (3) and distributed over the length of said tube (3).

7. An apparaus according to claim 6, in which said tube is provided in its lower part with one or more discharge openings (11) for discharging liquid collected by the tube (3) during spraying.

8. An apparatus according to claim 1, wherein said spraying means comprises a first cleaning device (2) for spraying alkaline liquid onto the metal body to be treated, and a second cleaning device (15) for spraying liquid acid onto said metal body, and further comprising a rinsing device (17) and a drying device (19).

9. An apparatus according to claim 1 for treating separate non-cohering metal parts, wherein said conveying means is a conveyor belt system (30) positioned along the spraying means to carry the metal parts along the spraying means in a continuous movement to the Conforming extrusion means.

10. A method for forming an article from an aluminum or aluminum alloy metal body, the entire surface of said metal body being exposed to air, comprising the steps of continuously plastically deforming of said metal body in a Conforming extrusion means wherein said surface of the metal body to be deformed does not substantially form a surface of said article and wherein said surface is not subjected to lubrication during deformation, continuously cleaning said metal body by spraying said surface exposed to air with a liquid chemical deoxidation and cleaning agent and continuously drying said metal body subsequent to said cleaning and prior to said deformation while continuously supplying said metal body to said Conforming extrusion means, wherein said step of cleaning is performed immediately prior to deformation such that substantially no new oxide layer is formed between said drying and said deforming steps.

11. A method according to claim 10, further comprising rinsing the surface of said metal body, after spraying with said deoxidation and cleaning agent.

12. A method according to claim 10, wherein said spraying comprises spraying said metal body with an alkaline agent and with an acid agent.

* * * * *